US005345232A

United States Patent [19]

Robertson

[11] Patent Number: 5,345,232

[45] Date of Patent: Sep. 6, 1994

[54] TRAFFIC LIGHT CONTROL MEANS FOR EMERGENCY-TYPE VEHICLES

[76] Inventor: Michael T. Robertson, 112 F Farrington Dr., Raleigh, N.C. 27615

[21] Appl. No.: 978,997

[22] Filed: Nov. 19, 1992

[51] Int. Cl.[5] ..... G08G 1/07

[52] U.S. Cl. ..... 340/906; 340/902; 340/904; 340/994; 340/995; 340/286.14

[58] Field of Search ..... 340/286.13, 286.14, 340/995, 994, 901, 902, 904, 906

[56] References Cited

U.S. PATENT DOCUMENTS

| | | | |
|---|---|---|---|
| Re. 28,100 | 8/1974 | Long . | |
| 1,251,666 | 9/1913 | Hoge . | |
| 2,881,409 | 4/1959 | Cook et al. . | |
| 3,257,641 | 6/1966 | Campana et al. | 340/906 |
| 4,017,825 | 4/1977 | Pichey . | |
| 4,200,904 | 4/1980 | Doan | 362/183 |
| 4,325,057 | 4/1982 | Bishop | 340/994 |
| 4,573,049 | 2/1986 | Obeck . | |
| 4,736,186 | 4/1988 | Jones . | |
| 4,914,434 | 4/1990 | Morgan et al. | 340/907 |
| 4,937,570 | 6/1990 | Matsukawa et al. | 340/994 |
| 5,014,052 | 5/1991 | Obeck . | |
| 5,103,400 | 4/1992 | Yamda et al. | 340/995 |
| 5,164,904 | 11/1992 | Sumner | 340/905 |

FOREIGN PATENT DOCUMENTS

| | | | |
|---|---|---|---|
| 0144796 | 6/1991 | Japan | 340/908 |

*Primary Examiner*—John K. Peng
*Assistant Examiner*—Niua Tong
*Attorney, Agent, or Firm*—John G. Mills and Associates

[57] ABSTRACT

This invention relates to traffic control means for emergency-type vehicles including an on-board plotter screen having a diagram of streets, roads, highways and the like displayed thereon. A light pen is used to draw the preferred route which is then either accepted or rejected in part or as a whole by a computer based on a current street condition program. Once the route has been accepted a traffic signal map program can be activated that will automatically control traffic along the route to the destination of the emergency vehicle.

12 Claims, 6 Drawing Sheets

TRAFFIC LIGHT CONTROL MEANS FOR EMERGENCY-TYPE VEHICLES

FIELD OF INVENTION

This invention relates to traffic control means and more particularly to semi-automated traffic control systems for emergency-type vehicles.

BACKGROUND OF INVENTION

Since cities and towns first became congested with people and vehicles, there have been problems in getting emergency vehicles from one place to another in a reasonable time.

With the development of signals sent by wire and later signals sent by radio waves, efforts have been made to utilize this capability to aid in the movement of emergency vehicles through congested areas. As early as 1918 remote signalling devices were used to control "Stop" and "Move" intersection signs. Later light signals were used to control stop lights to allow emergency vehicles to go through intersections with all other traffic stopped. Radio signals were used to do the same thing. Even later computer programs have been used to preempt the usual operation of traffic lights along a predetermined vehicle route. None of these various traffic control means, however, have been able to allow the emergency vehicle crew to choose alternate routes to their destination which are either accepted or rejected until a satisfactory route is established.

BRIEF DESCRIPTION OF INVENTION

After much research and study into the above mentioned problems, the present invention has been developed to provide an emergency vehicle on-board display which allows an the emergency vehicle crew to choose the route they think is best to their destination. This route is then either accepted or rejected in part or as a whole. If there is a rejection, then an alternate desired route is chosen which again can be either accepted or rejected.

The acceptance or rejection of the desired route is determined by a program comparing the marked desired route to an up-to-date street condition program into which detours, street repairs, signal outages, and even traffic congestion conditions are updated as necessary.

Once an acceptable desired route has been established, a traffic signal map program to control the traffic signals along the route can be activated to route the vehicle to its destination. Special warning signals are provided with both visual and audible means, the audible signals being coded to inform the visually impaired of the approaching emergency vehicle. Also means are provided for operating the emergency intersection signals independently of on-line electrical energy sources.

DISCUSSION OF PRIOR ART

The following references represent the closest prior art of which the inventor is aware and is intended to meet the requirements of 37 CFR 1.98 for Information Disclosure Statements:

List of Reference

U.S. Pat. No. 1,251,666
Issue Date: Jan. 1, 1918

Inventor: James B. Hoge
U.S. Pat. No. Re. 28,100
Issue Date: Aug. 6, 1974
Inventor: William H. Long
U.S. Pat. No. 4,017,825
Issue Date: Apr. 12, 1977
Inventor: Paul J. Pichey
U.S. Pat. No. 2,881,409
Issue Date: Apr. 7, 1959
Inventors: Vernon Lee Cook, Howard S. Knaack
Assignee: Em-Tec, Inc.
U.S. Pat. No. 3,257,641
Issue Date: Jun. 21, 1966
Inventors: Patsy C. Campana, Thomas T. Chrysler
Assignee: Chrys-Camp Controller, Inc.
U.S. Pat. No. 4,736,186
Issue Date: Apr. 5, 1988
Inventor: Richard D. Jones
U.S. Pat. No. 4,573,049
Issue Date: Feb. 25, 1986
Inventor: Carl J. Obeck
Assignee: Bourse Trading Company, Ltd.
U.S. Pat. No. 5,014,052
Issue Date: May 7, 1991
Inventor: Carl J. Obeck
Assignee: Bourse Trading Company, Ltd.

Concise Explanation of References

U.S. Pat. No. 1,251,666 issued to James B. Hoge discloses a municipal traffic control system that was rather advanced for its day. It includes the sending of signals from a central fire or police station to control traffic lights ("STOP" and "MOVE") as well as an aerial signal 65 having a whistle type warning signal therein.

U.S. Pat. No. Re. 28,100 issued to William H. Long discloses a traffic signal remote control system including a light source that activates a traffic signal so that an emergency vehicle can pass through the intersection with the green light.

U.S. Pat. No. 4,017,825 issued to Paul J. Pichey discloses an intersection emergency warning system which is activated by a radio signal from the emergency vehicle, such warning system including a siren 52 and rotating lights 54 and 56 connected below a normal traffic light 12.

U.S. Pat. No. 2,881,409 issued to Vernon Lee Cook and Howard S. Knaack discloses a signalling system including radio signals from the vehicle to a control box which controls the adjacent traffic light as clearly illustrated in FIG. 6. Also a flashing light is positioned on top of the traffic signal.

U.S. Pat. No. 3,257,641 issued to Patsy C. Campana and Thomas T. Chrysler discloses an emergency traffic control system including means for signalling a traffic light to make all lights turn red. This patent also discloses the use of emergency lights as well as an emergency siren.

U.S. Pat. No. 4,736,186 issued to Richard D. Jones discloses an emergency warning signal that is remotely activated and includes a solar panel 34 for charging batteries to operate a flashing light 12.

Finally, U.S. Pat. Nos. 4,573,049 and 5,014,052 issued to Carl J. Obeck disclose traffic light controls for emergency vehicles 1 including transmission of signals from the vehicle to a central control location 3 which in turn sends the signal to the intersection signal control 62 to control the light signal 2.

OBJECTS OF INVENTION

In view of the above it is an object of the present invention to provide a traffic control means for emergency-type vehicles which includes an on-board vehicle screen for plotting preferred routes to a destination.

Another object of the present invention is to provide a means for plotting a route to destination for emergency-type vehicles.

Another object of the present invention is to provide a means for plotting a route to destination for emergency-type vehicles wherein the desired route is selected which is either accepted or rejected by a street condition program.

Another object of the present invention is to provide a plotting means for emergency-type vehicles wherein the preferred route to destination can be selected, and once approved by a street condition program, a traffic signal program can be activated to clear intersections in the path of the vehicle.

Another object of the present invention is to provide, in combination with an emergency-type vehicle plotting system, traffic control means which emit emergency visual and audible signals.

Another object of the present invention is to provide, in combination with a route plotting system, special traffic control signals including coded audible signals for the visually handicapped.

Another object of the present invention is to provide, in combination with emergency-type vehicle route plotting means, special traffic controls which have back-up batteries and solar chargers to allow the system to continue to function even when the local power grid is down for an extended period of time.

Other objects and advantages of the present invention will become apparent and obvious from a study of the following description and the accompanying drawings which are merely illustrative of such invention.

DETAILED DESCRIPTION OF INVENTION

Figure 1:
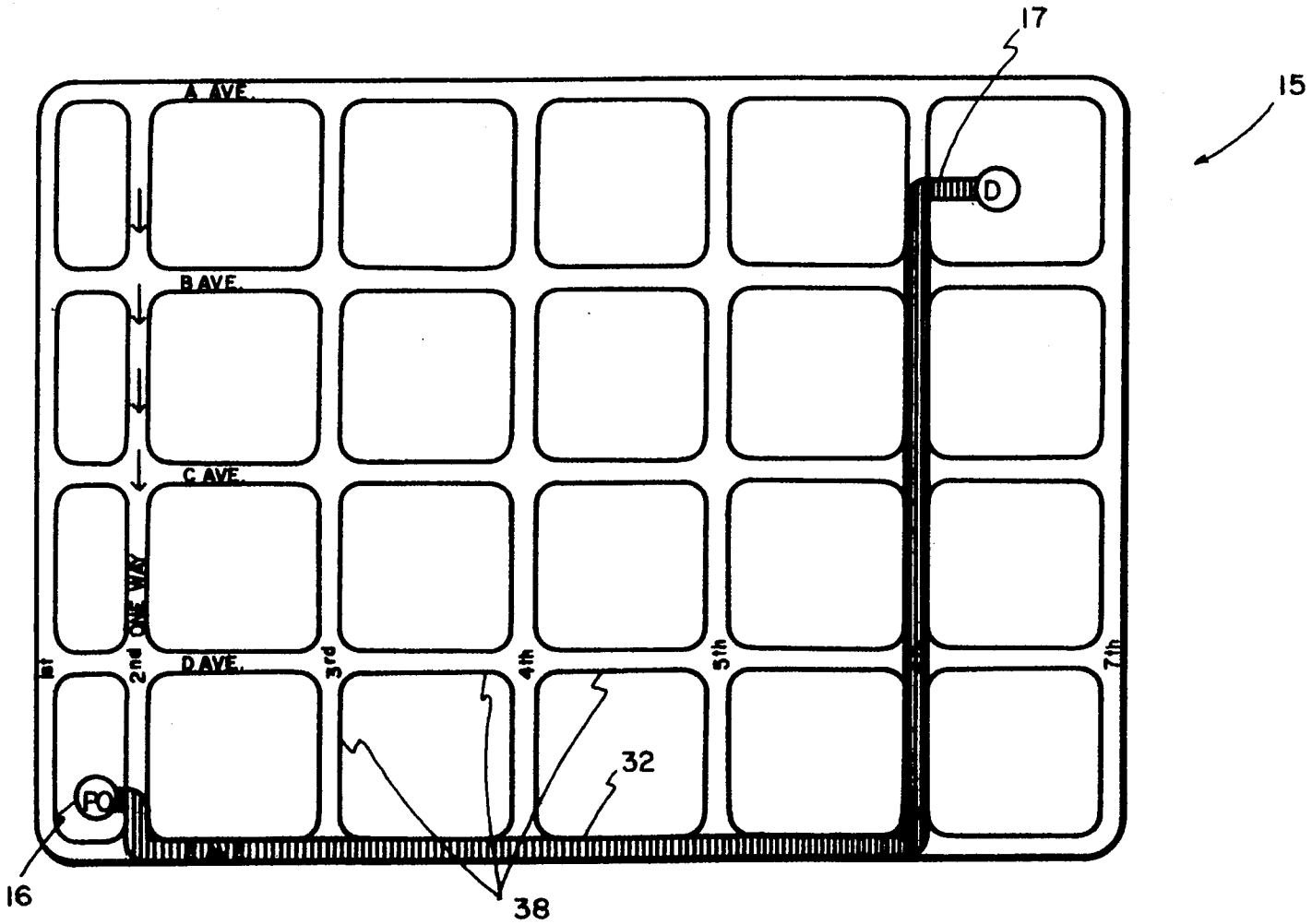
FIG. 1 is a plan view of a plotter screen which displays the street grid between the point of origin or present position of the emergency-type vehicle and its destination with the least turns plotted thereon.

With further reference to the drawings, the traffic control means for emergency-type vehicles of the present invention, indicated generally at 10, includes an emergency or similar vehicle, indicated generally at 11, a radio signal receiving means, indicated generally at 12, a curb mounted emergency warning means, indicated generally at 13, and an aerial emergency warning means, indicated generally at 14.

Inside the cab 27, or other convenient location within the vehicle 11, is an operatively mounted on-board display or plotter screen, indicated generally at 15. This screen is computer driven and is programmed to map out the entire area that the emergency-type vehicle in question is expected to cover or be on call to cover. This road map program is similar to the electronic maps that are on the market today and further detailed discussion of this part of the present invention is not deemed necessary.

The road map program is only required to display the road or street pattern between either the point of origin or the present position of the emergency vehicle 16 to the point of destination 17.

When beginning an emergency call, the point of origin and the present location of the emergency vehicle would, of course, be the same. Should unexpected difficulties arise in route, then the emergency vehicle crew can plot an acceptable route from such location to the point of the destination. In a major disaster situation such as the aftermath of a hurricane, tornado, ice storm, earthquake, or other catastrophic event causing widespread destruction, this present location to point of designation plotting capability could be a particularly valuable asset.

Radio signal receiving means are preferably disposed in the area adjacent all intersections having normal traffic control lights 18 or 25 and emergency warning means 13 or 14. Since radio signal receiving means are well known to those skilled in the aft, further detailed discussion of this portion of the present invention is not deemed necessary. The function and operation of such signal receiving means will hereinafter be described in greater detail.

The curb mounted emergency warning means 13 of the present invention includes a base 19, a pedestal portion 20, and normal traffic control lights 18. Since the construction and normal operation of traffic control lights are well known to those skilled in the art, further detailed discussion thereof is not deemed necessary.

Figure 5:
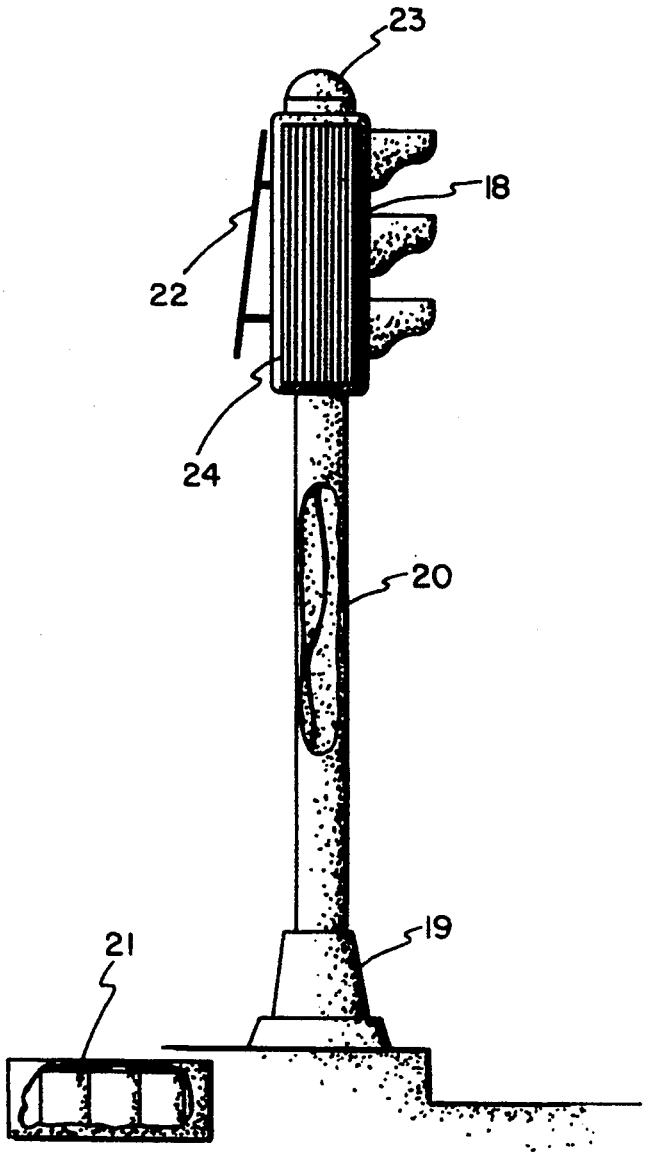
FIG. 5 is a partially cutaway elevational view of a curb mounted traffic signal with the warning system of the present invention incorporated therein.
Figure 6:
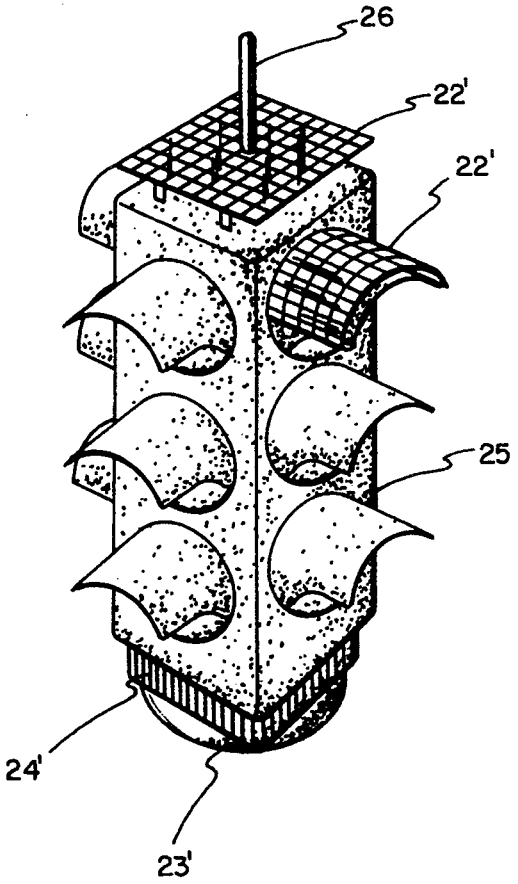
FIG. 6 is a perspective view of a suspended traffic signal incorporating such warning features.
Figure 7:
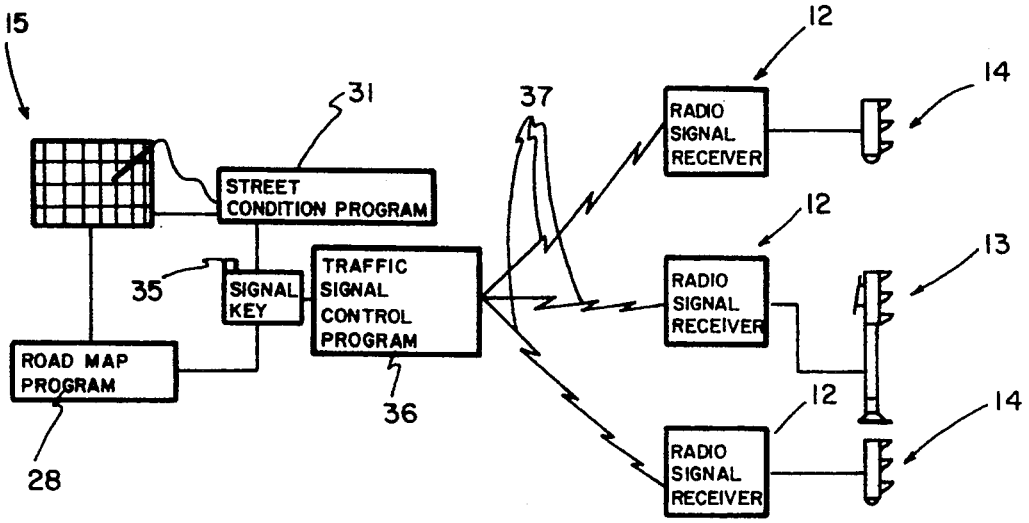
FIG. 7 is a schematic view of the hardware that runs the various programs of the present invention and how this is transmitted to emergency warning systems.

In addition to the normal curb mounted traffic control system described above, an emergency battery pack 21 is provided and can be mounted either underground as shown in FIG. 5, in the base 19, in the pedestal portion 20, or in any other desired convenient location. This battery pack is of the rechargable type and is adequately sized to operate the emergency warning means 13 over an extended period of time.

At some convenient location such as on the side of the traffic control light 18 is a photovoltaic module or solar electric panel so disposed as to receive sunlight. This module or panel, or multiplicity thereof, are designed to keep the emergency battery pack 21 fully charged and to recharge the same when it has been discharged due to emergency operation. Since photovoltaic modules or panels are readily available and their connection to and operation in conjunction with rechargable battery packs are well known, further detailed discussion of this portion of the present invention is not deemed necessary.

The curb warning means 13 includes a bright, 360 degree flashing light warning means 23 mounted on top of traffic light 18. Since red is the universal color used to warn pedestrians and drivers of vehicles, the lens on warning light 23 is preferably red. Since flashing strobe lights are extremely bright, can be mounted for 360 degree visibility, and require very little electrical current to operate, this is the preferred source of light although, of course, other sources could be substituted there for.

In addition to the above, there is an audible warning means 24 mounted adjacent curb traffic control light 18. This audible warning means can be of any desired type but it is preferably programmed to give off an audible sound that is coded, such as long and short warning sounds that can be interpreted as Morse code-type signals so that the visually handicapped can be taught to understand the meaning thereof. This will tell them the direction the emergency vehicle is approaching from and which direction it will go when it departs from the intersection, as well as any other pertinent data deemed desirable or necessary.

Since audible warning means are well known to those skilled in the art, further detailed discussion of this portion of the present invention is not deemed necessary.

Suspended aerial traffic control lights 25 are often used instead of the curb mounted control lights. This is particularly true when two or more lanes going the same way are involved or there is at least one thru lane and one turn lane. The normal operational function of suspended traffic control lights is well known to those skilled in the art and further detailed discussion of the same is not deemed necessary.

On one or more of the suspended traffic lights 25 are mounted, either on top, or on one or more or the light visors, photovoltaic modules or solar electric panels 22' which function in the same manner as modules or panels 22 on mounted on curb traffic control lights 18. Also provided, preferably on the underside of the suspended traffic control light 25, is a flashing light warning means 23' and an audible warning means 24'. The function of both of these warning means is the same as light warning means 23 and audible warning means 24 and, therefore, further detailed discussion of the same is not deemed necessary.

The road map program 28, the street condition program 31 and the traffic signal control program 36 can all be some be located as on board computers, or one or more can be remotely located with data being transmitted back and forth to and from the emergency vehicle 11. Since the interfacing and operation of these types of computer programs are well known to those skilled in the art, further detailed discussion of same is not deemed necessary.

A support means 26 is provided in operative connection with suspended traffic control light 25 to mount the same.

To use the traffic control means for emergency-type vehicles of the present invention, when an emergency call comes in to the point of origin 16, be it a police station, a fire station, emergency medical station, or any other quick-response team location, the emergency vehicle 11 will be manned and will roll. As soon as the crew gets into the cab 27 they will feed their position 16 and the point of destination 17 into the road map program 28. This program will display the street layout from such present position to said point of destination on the plotter screen 15 as clearly shown in FIGS. 1 through 3. A light pen 29 operatively connected through coiled cold 30 to street conditioned program 31 is used to trace the most direct route with the fewest turns from point 16 to point 17 as shown on drawn route line 32 in FIG. 1.

Presuming there were one or more problems along the proposed route 32 such as road blocks, detours, inoperative traffic lights, traffic jams, or the like, then this route would be rejected by the street condition program 31 and the route 32 would appear in red indicating rejection.

Figure 2:
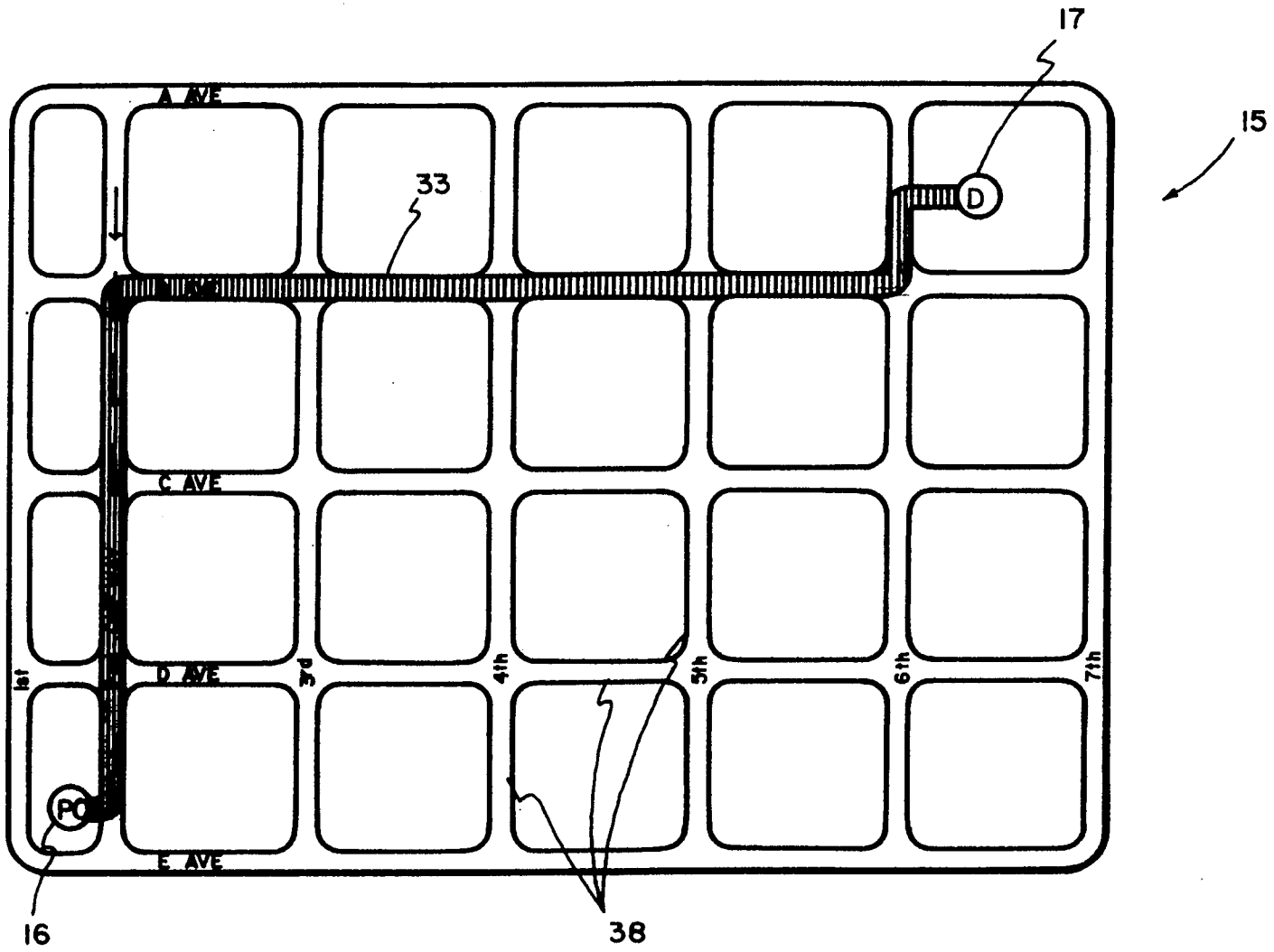
FIG. 2 is a view of the plotter screen with a first alternate route having been chosen.

The crew in vehicle 11 would then draw what they considered the second best alternative route line 33 shown in FIG. 2. For sake of illustration, this route is also not available for one or more of the reasons given in the rejection of route 32.

Figure 3:
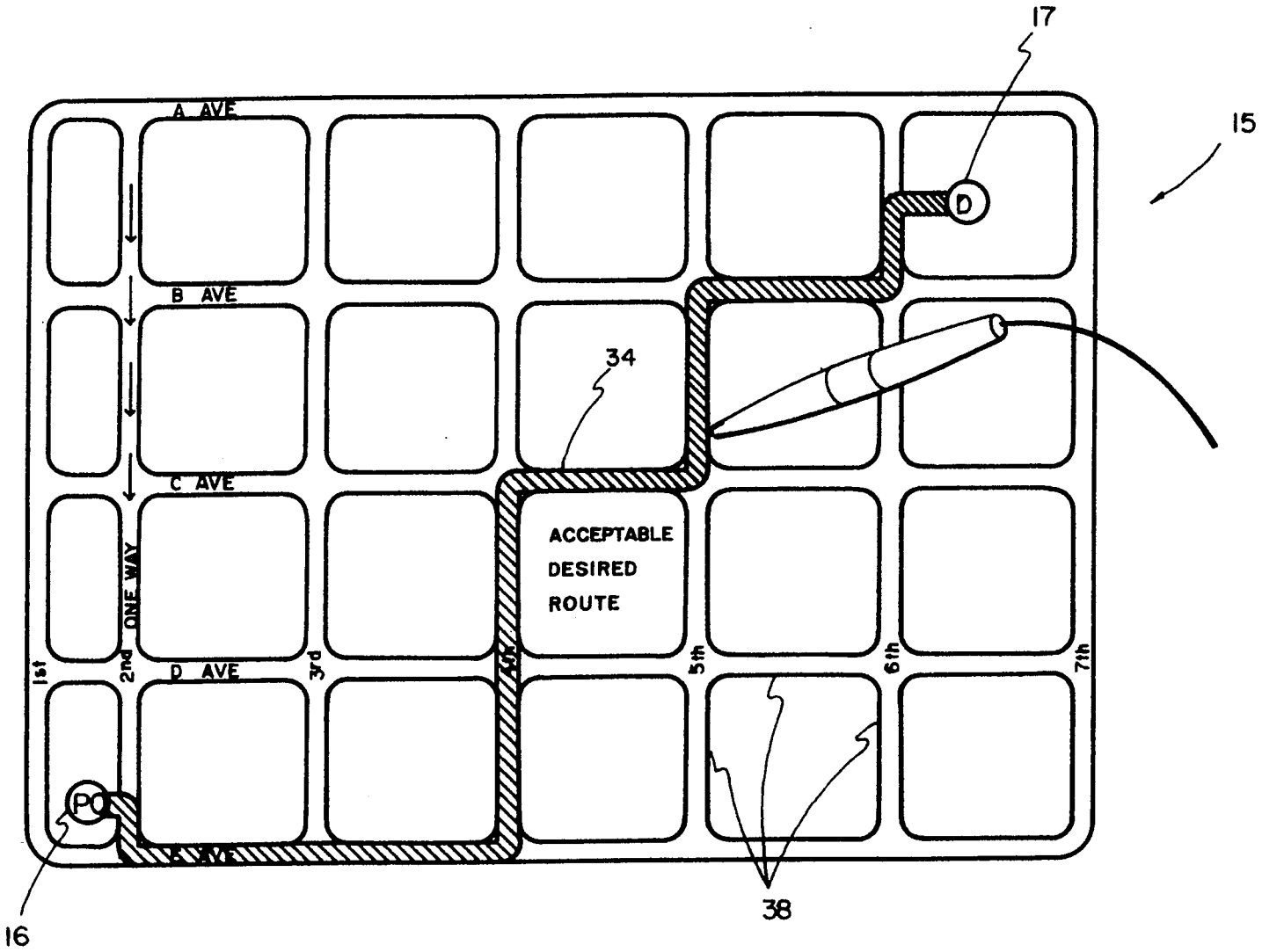
FIG. 3 is a view of the plotter screen with an accepted third alternate route plotted thereon.
Figure 4:
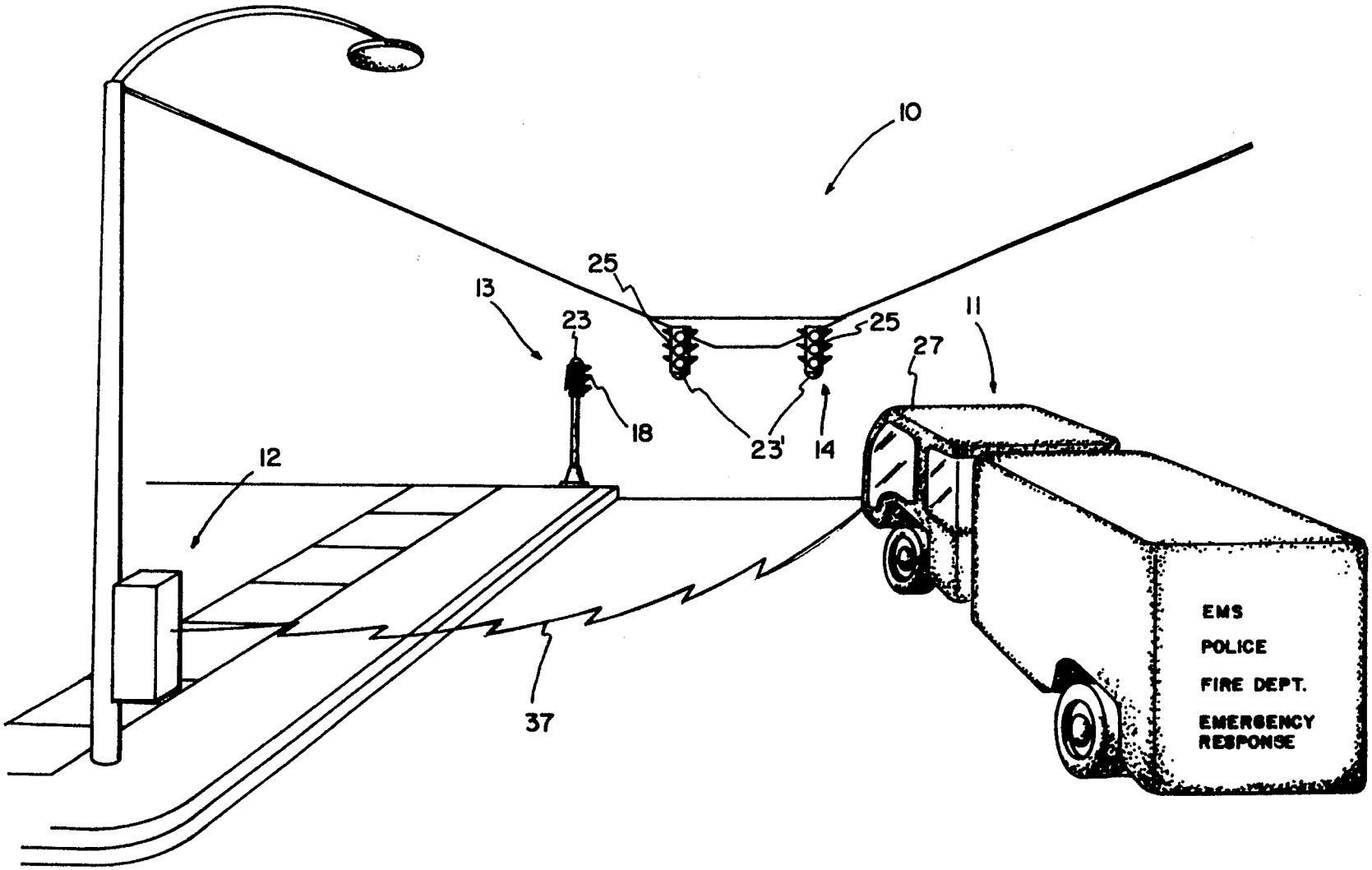
FIG. 4 is a perspective view of the system of the present invention in operation.

A third alternate route line 34 is drawn with light pen 29 as illustrated in FIG. 3. This route line is found to be acceptable by the street condition program 31 and it appears green on the plotter screen 15.

Now that an acceptable, available route has been established, signal key 34 is pressed to activate the traffic signal control program 36 in accordance with the acceptable route line 34. The traffic control program 36 then sends signals to the various emergency warning means 13 and 14 along the route 34 of the emergency vehicle 11. These signals are, of course, controlled by program 32 and can be either in a specific sequential pattern or simultaneous in operation. Also the signal sent from the traffic signal control program 36 to the signal receiving means 12 can be either radio signals or land line signals. Radio signals are, of course, preferred since land line signals that are overhead are subject to storm damage, ice damage, etc. while underground land lines are subject to earthquake fracture and the like.

When the emergency warning means 13 and 14 are activated, they automatically turn off the traffic lights 18 and/or 25 and turn on the flashing lights 23 and 23' and the preprogrammed audible alarms 24 and 24' which, as discussed above can give specific messages to the visually impaired.

The above described system can operate completely independent of the municipal electrical system since the solar panels 22 and 22' keep the storage batteries 21 fully charged to power the flashing lights 23 and 23', and audible signals 24 and 24' as well as the radio signal receiving means 12. This self containment of the traffic control means for emergency type vehicles of the present invention is particularly valuable in hurricane and tornado ravaged areas as well as following earthquakes, ice storms and other catastrophic disasters.

Also, should unexpected impediments to moving rapidly along the chosen route be encountered, the light pen 29 can be used to choose an additional alternate route for the emergency vehicle 11 to the point of destination 17 so that valuable time will not be lost by the vehicle wandering around not knowing which route is unobstructed and available.

From the above it can be seen that the present invention provides a simple to operate and yet highly efficient means for the crew of an emergency type vehicle to determine the best route to follow from either the point of origin or their present position to the desired point of destination. This system is operative even when normal municipal or power company electrical systems are down, which normally renders all traffic control lights inoperative.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A traffic control for emergency-type vehicle comprising: means for selectively plotting a route from the location of the vehicle to a pre-determined destination; a street condition program operatively connected to said means for plotting said route whereby the route plotted will automatically be either accepted or rejected by said street condition program; once a selected route is accepted by said street condition program, means for automatically signalling emergency warning means at intersections along said accepted route whereby said emergency-type vehicle can reach its said predetermined destination without undue delay.

2. The traffic control of claim 1 wherein a road map program is operatively associated with said means for selectively plotting a route from the location of the vehicle to the predetermined destination.

3. The traffic control of claim 2 wherein a traffic signal control program is operatively connected between said means for selectively plotting a route from the location of the vehicle to the predetermined destination and the means for signalling emergency warning means at said intersections along said accepted route whereby said warning means can be activated in the manner for said emergency vehicle to reach its predetermined destination without undue delay.

4. The traffic control of claim 1 wherein the emergency warning means at said intersections along said accepted route include flashing light warning and audible warning.

5. The traffic control of claim 4 wherein said audible warning are coded to give specific information to a visually impaired.

6. The traffic control of claim 4 wherein said emergency warning means include a battery back-up means.

7. The traffic control of claim 6 wherein the battery back-up means is charged by solar electric panels.

8. The traffic control of claim 4 wherein the emergency warning means is operatively connected to a battery back-up means.

9. The traffic control of claim 1 wherein the emergency warning means are mounted adjacent traffic control lights and include means for cutting off said traffic control lights and turning on light warning and audible warning.

10. The traffic control of claim 9 wherein said light warning is a flashing means.

11. The traffic control of claim 9 wherein the audible warning means is coded for a visually impaired.

12. A traffic control for emergency-type vehicle comprising: means for selectively plotting a route from the location of the vehicle to a pre-determined destination including a road map program operatively connected thereto; a street condition program operatively connected to said means for plotting said route whereby the route plotted will automatically be either accepted or rejected by said street condition program; once a route is accepted by said street condition program, a traffic signal control program operatively connected to said means for selectively plotting said route for determining the manner of controlling emergency warning means at intersections along said accepted routes; and means for signalling information from said traffic signal control program to said warming means at said intersections whereby said emergency-type vehicle can reach its predetermined destination without undue delay.

* * * * *